US011693366B2

(12) United States Patent
Winkler et al.

(10) Patent No.: US 11,693,366 B2
(45) Date of Patent: Jul. 4, 2023

(54) FLEXIBLE GUIDE AND SET OF SUPERIMPOSED FLEXIBLE GUIDES FOR ROTARY RESONATOR MECHANISM, IN PARTICULAR OF A HOROLOGICAL MOVEMENT

(71) Applicant: ETA SA Manufacture Horlogère Suisse, Grenchen (CH)

(72) Inventors: Pascal Winkler, St-Blaise (CH); Jean-Luc Helfer, Le Landeron (CH); Yves-Alain Cosandier, Renens (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 307 days.

(21) Appl. No.: 17/023,565

(22) Filed: Sep. 17, 2020

(65) Prior Publication Data

US 2021/0124306 A1 Apr. 29, 2021

(30) Foreign Application Priority Data

Oct. 25, 2019 (EP) ..... 19205242

(51) Int. Cl.
*G04B 17/04* (2006.01)
*G04B 17/08* (2006.01)

(52) U.S. Cl.
CPC ..... *G04B 17/045* (2013.01); *G04B 17/08* (2013.01)

(58) Field of Classification Search
CPC ..... G04B 17/04; G04B 17/045; G04B 17/08
See application file for complete search history.

(56) References Cited

U.S. PATENT DOCUMENTS 9,599,961 B2 * 3/2017 Stranczl ..... G04B 17/285
2017/0010586 A1 * 1/2017 Di Domenico ..... G04B 17/045
(Continued)

FOREIGN PATENT DOCUMENTS

CH 709 811 A2 12/2015
CN 105717777 A 6/2016
(Continued)

OTHER PUBLICATIONS

Combine Russian Federation Office Action and Search Report dated Apr. 28, 2021 in Russian Federation Patent Application No. 2020134721/28(063781) (with English translation), 11 pages.
(Continued)

*Primary Examiner* — Sean Kayes
(74) *Attorney, Agent, or Firm* — Oblon, McClelland, Maier & Neustadt, L.L.P.

(57) ABSTRACT

A flexible guide for a rotary resonator mechanism, in particular of a horological movement, the guide including a first support, an element movable relative to the first support, a first pair of flexible strips connecting the first support to the movable element, so that the movable element can displace relative to the first support by bending the strips in a circular movement about a centre of rotation, the flexible guide being arranged substantially in a plane, including a prestressing device, the prestressing device being configured to apply a force for buckling the flexible strips by bringing the first support closer to the movable element, so that the flexible guide includes two stable positions of the element movable relative to the first support for which the return moment is zero, the two stable positions having a predetermined angle of rotation therebetween.

10 Claims, 3 Drawing Sheets

(56) References Cited

U.S. PATENT DOCUMENTS

| | | | |
|---|---|---|---|
| 2017/0123380 | A1 | 5/2017 | Winkler et al. |
| 2018/0113420 | A1 | 4/2018 | Winkler et al. |
| 2019/0011887 | A1 | 1/2019 | Mallet et al. |
| 2019/0032644 | A1 | 1/2019 | Winkler et al. |

FOREIGN PATENT DOCUMENTS

| | | | |
|---|---|---|---|
| CN | 107065493 | A | 8/2017 |
| CN | 108138837 | A | 6/2018 |
| CN | 109212943 | A | 1/2019 |
| CN | 109307998 | A | 2/2019 |
| CN | 109426127 | A | 3/2019 |
| CN | 109426128 | A | 3/2019 |
| CN | 110235064 | A | 9/2019 |
| EP | 3 316 047 | A1 | 5/2018 |
| EP | 3 410 229 | A1 | 12/2018 |
| EP | 3 425 458 | A1 | 1/2019 |
| EP | 3 435 173 | A1 | 1/2019 |
| RU | 2 603 954 | C1 | 12/2016 |
| RU | 2017 134 933 | A | 4/2019 |
| RU | 2017 135 092 | A | 4/2019 |

OTHER PUBLICATIONS

Combine Chinese Office Action and Search Report dated Aug. 23, 2021 in Chinese Patent Application No. 202011148162.1 (with English translation of Category of Cited Documents), 8 pages.
European Search Report dated Apr. 8, 2020 in European Applcation 19205242.1 filed Oct. 25, 2019 (with English Translation of Categories of Cited Documents), 3 pages.
Combine Chinese Office Action and Search Report dated Aug. 23, 2021 in Chinese Patent Application No. 202011148162.1 (with English Translation of Category of Cited Documents), 9 pages.

* cited by examiner

FLEXIBLE GUIDE AND SET OF SUPERIMPOSED FLEXIBLE GUIDES FOR ROTARY RESONATOR MECHANISM, IN PARTICULAR OF A HOROLOGICAL MOVEMENT

CROSS-REFERENCE TO RELATED APPLICATION

This application claims priority to European Patent Application No. 19205242.1 filed on Oct. 25, 2019, the entire disclosure of which is hereby incorporated herein by reference.

FIELD OF THE INVENTION

The present invention relates to a flexible guide for a rotary resonator mechanism. The invention also pertains to a set of superimposed flexible guides for a rotary resonator mechanism. The invention also pertains to a horological movement provided with such a flexible guide or with such a set of superimposed flexible guides.

BACKGROUND OF THE INVENTION

Most of today's mechanical watches are provided with a balance-spring and a Swiss lever escapement mechanism. The balance-spring constitutes the time base of the watch. It is also called a resonator.

The escapement, in turn, fulfils two main functions: maintaining the back and forth movements of the resonator; counting these back and forth movements.

The Swiss lever escapement mechanism has a low energy efficiency (around 30%). This low efficiency results from the fact that the movements of the escapement are jerky, that there are drops or lost paths to accommodate machining errors, and also from the fact that several components transmit their movement to each other via inclined planes which rub against each other.

To constitute a mechanical resonator, an inertial element, a guide and an elastic return element are needed. Traditionally, a spiral spring acts as an elastic return element for the inertial element that a balance constitutes. This balance is guided in rotation by pivots which rotate in plain ruby bearings. This gives rise to friction, and therefore to energy losses and operating disturbances, which depend on the positions, and which one seeks to eliminate.

There are also rotary resonators pivoting about an axis of rotation and subjected to a motor torque, which perform a continuous rotary movement around an axis.

Application EP 17194636.1 describes such a resonator mechanism including a plurality of inertial elements movable relative to the central moving body of the resonator, and returned towards its axis of rotation by elastic return means. When rotating, the resonator deploys in a plane perpendicular to the axis of rotation of the resonator.

Another application EP17183211.6 shows a rotary resonator including at least one inertial element arranged to pivot relative to the central moving body about a secondary axis perpendicular to the axis of the central moving body. While rotating, the resonator deploys in a plane containing the axis of rotation of the resonator.

In these applications, there are in particular embodiments of rotary resonators including flexible strip guides as elastic return means of the inertial element(s). The flexible virtual pivot guides allow to significantly improve the performance of timepiece resonators. The simplest are crossed-strip pivots, composed of two guide devices with straight strips which cross each other, generally perpendicularly. But there are also RCC (Remote Centre Compliance) type uncrossed-strip pivots, for which the centre of rotation is outside the structure of the pivot, and which have straight strips that do not cross each other.

It is possible to optimise a three-dimensional strip guide for a resonator, in an attempt to make it isochronous with an operation independent of its orientation in the gravity field. In the case of rotary resonators described in the state of the art, it is sought to obtain an elastic return moment of the flexible guide, which has a sinusoidal shape. For some cases of rotary resonators described in the state of the art, the return moment allowing a perfect isochronism to be achieved obeys the following law:

$M=-k \sin(2\theta)$, where $\theta$ is the guide deformation angle and k a spring constant. Thus, the return moment increases up to an angle of deformation of the guide, for example of 45°, then it decreases to another angle, for example 90°.

However, the flexible guide rotary resonators described in the state of the art do not meet this requirement, so that they do not achieve sufficient isochronism to be efficient.

SUMMARY OF THE INVENTION

A purpose of the invention is, consequently, to provide a flexible guide for a rotary resonator mechanism, which avoids the aforementioned problems.

To this end, the invention relates to a flexible guide for a rotary resonator mechanism, in particular of a horological movement, the guide comprising a first support, an element movable relative to the first support, a first pair of flexible strips connecting the first support to the movable element, so that the movable element can displace relative to the first support by bending the strips in a circular movement about a centre of rotation, the flexible guide being arranged substantially in a plane.

The flexible guide is remarkable in that it comprises prestressing means, the prestressing means being configured to apply a force for buckling the flexible strips by bringing the first support closer to the movable element, so that the flexible guide comprises two stable positions of the element movable relative to the first support for which the return moment is zero, the two stable positions having a predetermined angle of rotation therebetween.

Thanks to the invention, a flexible strip guide which can move between two stable positions, and whose behaviour is close to an ideal guide for a rotary resonator is obtained. Such a flexible guide guarantees an isochronism and an operation independent of the gravity field. Indeed, the buckling force of the strips allows to transform the linear return moment of a flexible guide without constraint into a bistable return moment, the return moment having a substantially sinusoidal shape, between the two stable angular positions of the movable element.

According to an advantageous embodiment, the return moment of the flexible guide has a substantially sinusoidal shape between the two stable angular positions.

According to an advantageous embodiment, the movable element has an axial symmetry and a centre of rotation, the flexible strips being directed towards the centre of rotation.

According to an advantageous embodiment, the prestressing means comprise a spring connecting the movable element and the first support.

According to an advantageous embodiment, the flexible guide comprises a second support and a second pair of flexible strips connecting the second support to the movable element, the second support and the second pair of strips being arranged by symmetry of the first support and the first pair of flexible strips relative to the movable element, the two pairs of flexible strips connecting on either side the first and the second support to the movable element at its centre of rotation.

According to an advantageous embodiment, the prestressing means include a holding component comprising two arms, each arm being fixed to a support, so as to apply the buckling force on one support towards the other support.

According to an advantageous embodiment, the holding component comprises elastic structures arranged on the arms to be in contact with each support.

According to an advantageous embodiment, the movable element is partly deformable at the centre of rotation.

According to an advantageous embodiment, each arm of the holding component comprises a deformable portion.

The invention also pertains to a set of superimposed flexible guides comprising at least two flexible guides according to the invention, the supports of the second flexible guide being fixed to the movable element of the first flexible guide.

According to an advantageous embodiment, the set comprises a third flexible guide superimposed on the second flexible guide, the supports of the third flexible guide being fixed to the movable element of the second flexible guide.

The invention also pertains to a rotary resonator mechanism of a horological movement, the mechanism including a central moving body arranged to pivot about a central axis and at least two inertial elements arranged to pivot relative to the central moving body about a secondary axis. The mechanism comprises two flexible guides, each flexible guide connecting an inertial element to the central moving body.

The invention also pertains to a rotary resonator mechanism of a horological movement, the mechanism including a central moving body arranged to pivot about a central axis and at least two inertial elements arranged to pivot relative to the central moving body about a secondary axis. The mechanism comprises two sets of superimposed flexible guides, each set connecting an inertial element to the central moving body.

BRIEF DESCRIPTION OF THE DRAWINGS

Other features and advantages of the present invention will become apparent upon reading several embodiments given only by way of non-limiting examples, with reference to the appended drawings wherein.

DETAILED DESCRIPTION OF PREFERRED EMBODIMENTS

Figure 1:
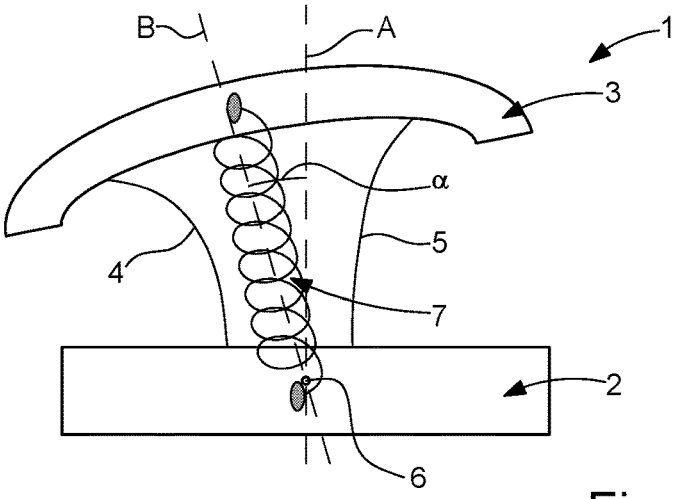
FIG. 1 schematically shows a top view of a flexible guide according to a first embodiment of the invention, FIG. 2 schematically shows a flexible guide according to a second embodiment of the invention.

FIG. 1 shows a flexible guide 1 comprising a support 2, an element 3 movable relative to the support 2 and two uncrossed flexible strips 4, 5 connecting the movable element 3 to the support 2. The movable element 3 has a circular arc shape, the strips 4, 5 being arranged on the internal side of the arc. The strips 4, 5 are of the same length and arranged symmetrically to join the support 2. Without prestress, the strips 4, 5 are oriented in two directions, which cross each other at a point 6 of the support 2, the point 6 defining a centre of rotation of the movable element 3. The movable element 3 can displace relative to the support 2 by bending the flexible strips 4, 5. The flexible guide 1 is arranged substantially in a plane According to the invention, the flexible guide 1 comprises prestressing means 7 configured to apply a force for buckling the flexible strips 4, 5 by bringing the movable element 3 closer to the support 2. To this end, the prestressing means 7 comprise, for example, a spring fixed on the one hand to the support 2 and on the other hand to the movable element 3. Preferably, the spring is substantially fixed at the centre of mass of the movable element 3.

The spring exerts a tensile force which brings the movable element 3 closer to the support 2. Thus, a buckling force constrains the strips to bend to put the movable element 3 in a stable position for which the return moment is zero. In FIG. 1, the movable element displaces to a stable position towards the left of FIG. 1. Without prestress, the movable element 3 is centred on the axis A, while in the stable position induced by the prestress, the movable element 3 is centred on the axis B. The axis B forms an angle $\alpha$ with the axis A.

There is a second stable position, not shown in FIG. 1, wherein the movable element 3 can be positioned relative to the support, and for which the return moment is zero. The second position is symmetrical to the first one relative to the axis A, the movable element being displaced to the right forming an angle $-\alpha$ with the axis A. Thus, between the two stable positions, the angle is equal to $2\alpha$. Furthermore, the return moment of the flexible guide 1 has a substantially sinusoidal shape. Thanks to the prestressing means 7, the movable element 3 can switch from one stable position to the other depending on the forces that urge it.

In an application to a rotary resonator mechanism, such as those described in the applications mentioned in the preamble, two flexible guides are used to replace those described in these applications. The supports are fixed to the central element, while the movable elements are each fixed to an inertial element.

Figure 2:
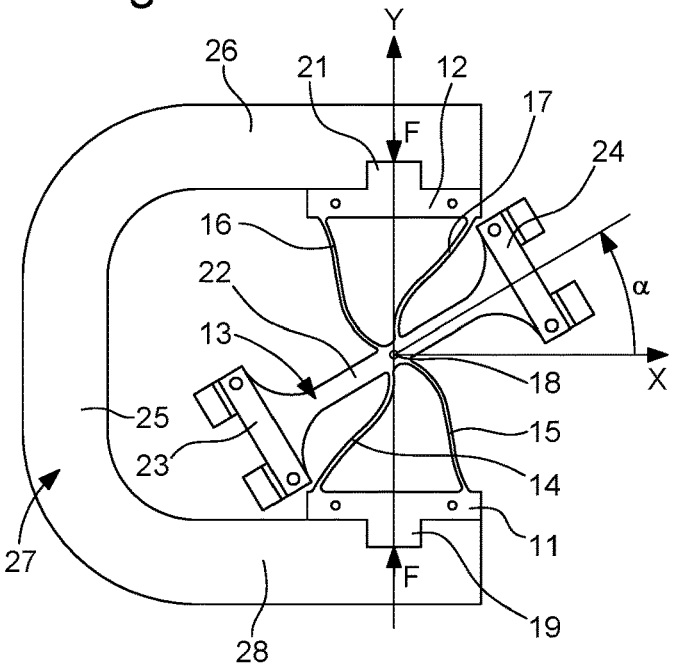
Figure 4:
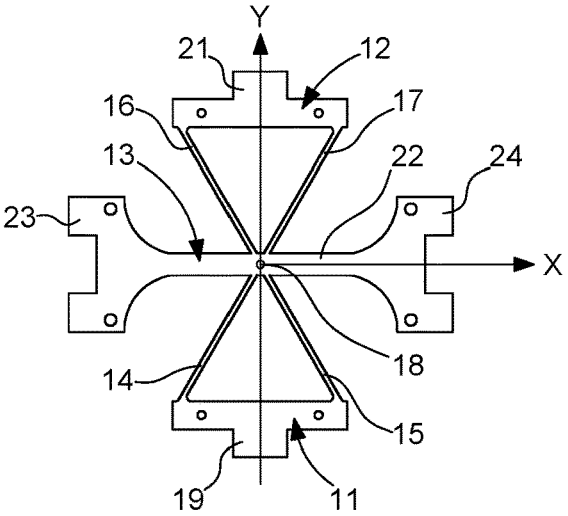
Figure 5:
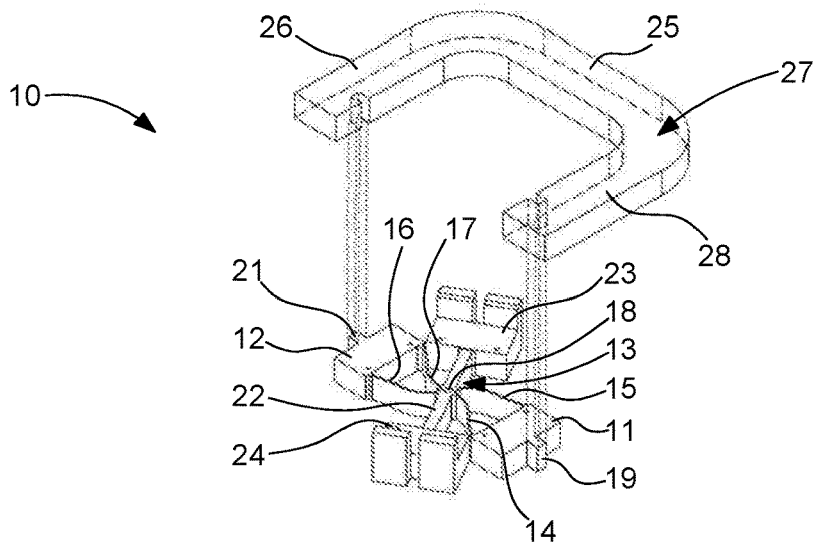

FIGS. 2 and 5 show a second embodiment of a flexible guide 10 according to the invention. For the understanding, FIG. 4 also shows, the same flexible guide 10 without prestressing means. The flexible guide 10 comprises a first 11 and a second 12 support, a movable element 13 relative to the supports 11, 12, two pairs of uncrossed flexible strips 14, 15, 16, 17 allowing the movable element 13 to move relative to the supports 11, 12. The flexible guide 10 is arranged substantially in a plane. Each pair of strips 14, 15, 16, 17 connects one of the supports 11, 12 to the movable element 13. The strips of a pair 14, 15, 16, 17 join the movable element at a centre of rotation 18 of the movable element 13. The supports 11, 12 have a parallelepiped shape provided with a rear block 19, 21. The strips 14, 15, 16, 17 start from two opposite ends of the support 11, 12 towards the middle of the movable element 13. The flexible guide 10 is arranged substantially in a plane.

The movable element 13 comprises a longitudinal part 22 and a U-shaped structure 23, 24 at each end of the longitudinal part 22. Each end is connected to the base centre of the U of the structure 23, 24. Thus, the movable element 13 has an axial symmetry along its longitudinal part 22. The middle of the longitudinal part forms the centre of rotation 18 of the movable element 14.

Without prestressing means, as shown in FIG. 4, the strips 14, 15, 16, 17 of a pair and the supports 11, 12 have the shape of an isosceles triangle, the main vertex of which is arranged in the middle of the movable element 13. The flexible guide 10 has two perpendicular axes of symmetry X, Y. The first axis X passes longitudinally through the axis of the longitudinal part 22, and the second axis Y passes through the supports 23, 24 so as to divide them into two equal parts. The two axes X, Y also pass through the centre of rotation 18 of the flexible guide 10. Thus, the two strips 14, 15, 16, 17 of the same pair are symmetrical relative to the second axis Y. The two U-shaped structures are also symmetrical relative to the second axis of symmetry Y. The two supports 11, 12 are symmetrical relative to the first axis of symmetry X.

The movable element 22 is configured to be able to rotate around the centre of rotation 18 thanks to the flexibility of the strips 14, 15, 16, 17. The centre of rotation 18 is arranged substantially at its centre of mass. Depending on the actuation of the guide 10, the movable element 13 rotates in the plane of the flexible guide 10. Without prestress, the elastic return moment is linear depending on the angle of rotation relative to the equilibrium position of the mechanism. In addition, in this case there is only one stable position corresponding to the rest position of the movable element. The movable element is directed along the first axis of symmetry X, as shown in FIG. 4.

According to the invention, the flexible guide 10 comprises prestressing means 27 configured to apply a force F for buckling the flexible strips 14, 15, 16, 17 by bringing each support 11, 12 closer to the movable element 13. To this end, the flexible guide 10 is provided with a component for holding said supports 11, 12, the holding component forming said prestressing means 27. The holding component has a U-shaped body 25 whose two arms 26, 28, which are substantially parallel, each rests on one of the supports 11, 12. The distance between the two arms is less than the distance between the two supports 11, 12 without prestress. Thus, the arms 26, 28 press on the supports 11, 12 by applying the force F, which allows the flexible strips 14, 15, 16, 17 to be buckled to bring each support 11, 12 closer to the movable element 13. The buckling force F is directed along the second axis of symmetry Y of the flexible guide 10. Thus, the flexible strips 14, 15, 16, 17 of the two pairs are substantially curved. In response, the movable element 13 displaces in rotation at a determined angle $\alpha$ to reach a first stable position. The angle $\alpha$ is defined relative to the first axis of symmetry X, the first stable position being directed upwards in FIG. 2. Furthermore, the flexible guide 10 has a second stable angular position, not shown in the figures, the movable element 13 displacing in rotation at a determined angle $-\alpha$ downwards. The two angular positions are defined relative to the first axis of symmetry X and form an angle equal to $2\alpha$. The second position is symmetrical to the first one relative to the first axis of symmetry X of the flexible guide 10. The values of the angles of the stable positions depend on the force applied by the prestressing means.

Figure 3:
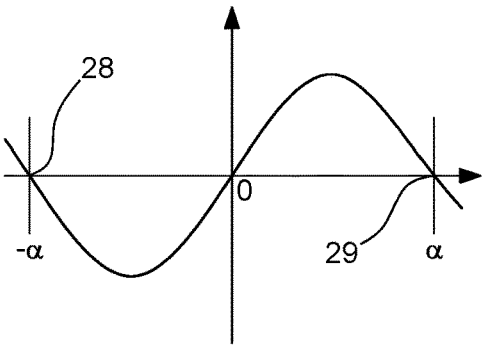
FIG. 3 is a graph showing the elastic return moment of the flexible guide as a function of the angle of rotation, FIG. 4 schematically shows a top view of the flexible guide of FIG. 2 without prestress, FIG. 5 schematically shows a perspective view of the flexible guide of the first embodiment which is partially disassembled, the prestressing means being separated from the rest of the guide, FIG. 6 schematically shows a top view of a flexible guide according to a first variant of the first embodiment, FIG. 7 schematically shows a top view of a flexible guide according to a second variant of the first embodiment, FIG. 8 schematically shows a top view of a flexible guide according to a third variant of the first embodiment, FIG. 9 schematically shows a top view of a set of flexible guides according to one embodiment of the invention, and FIG. 10 schematically shows a perspective view of the set of flexible guides of FIG. 9.

FIG. 3 shows a graph representing the return moment of the flexible guide 10 as a function of the angle of rotation of the movable element 13. Without prestressing means, the flexible guide of FIG. 4 would be a straight line passing through 0. Thanks to the prestressing means 27, the return moment describes a substantially sinusoidal function of one period between the two stable positions. The two stable positions 28, 29 correspond to the zero return moment and are located at the angle $\pm\alpha$. Thus, the elastic return moment of the flexible guide 10 is modified, so that the return moment has two stable positions and a substantially sinusoidal shape.

The movable element 13 can pass from one stable position to another according to the movement followed by the flexible guide 10. In particular in a rotary resonator mechanism, where the flexible guide 10 follows a rotational movement about a main axis of the mechanism. The movable element 13 is positioned in a position depending on the centrifugal force it undergoes. Thanks to such a flexible guide 10, the rotational speed of the resonator remains substantially constant, even if the driving force applied to the resonator mechanism varies.

Figure 6:
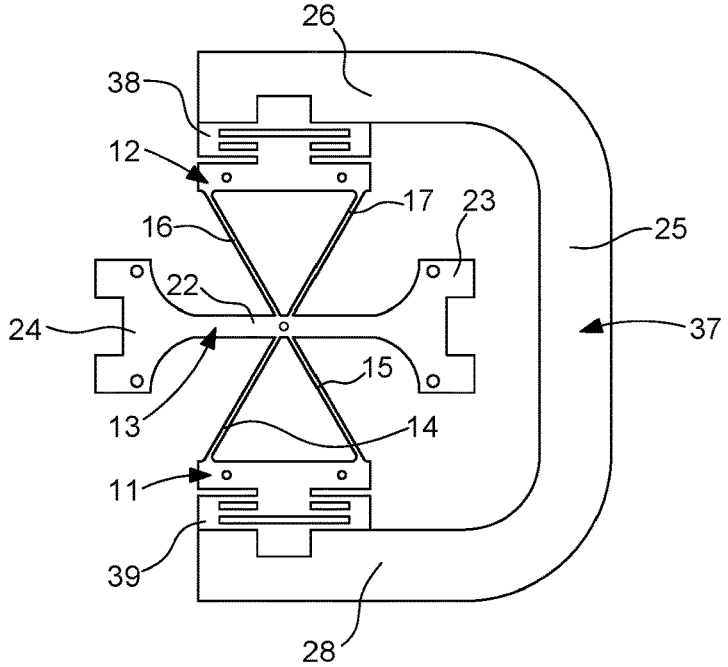
Figure 7:
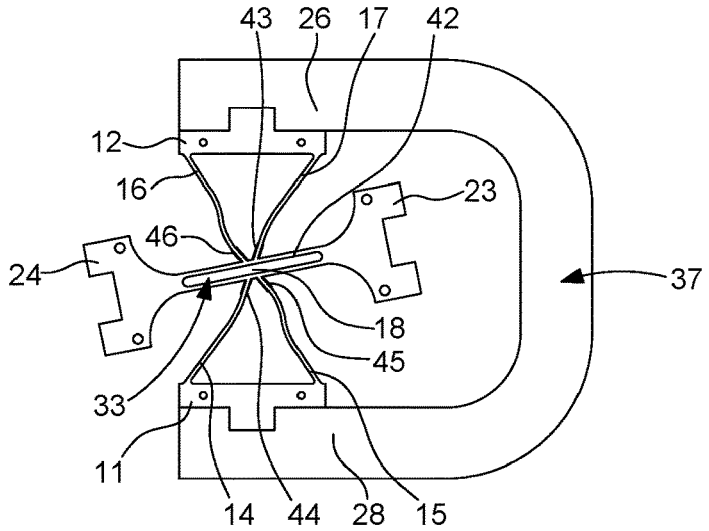
Figure 8:
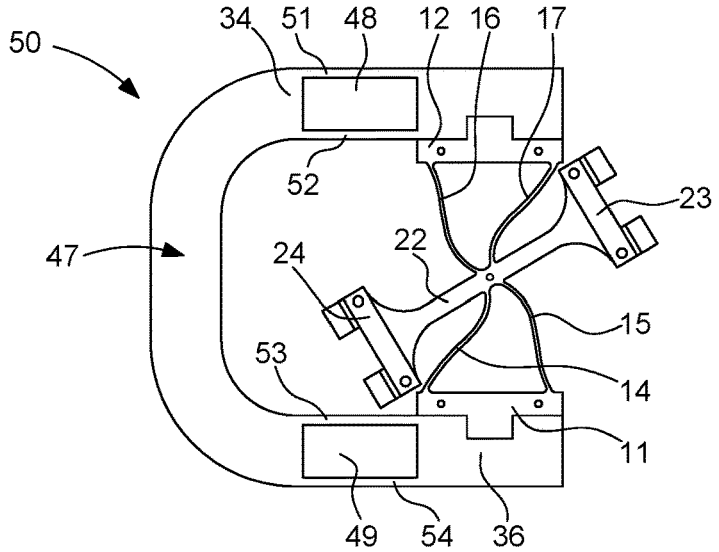

FIGS. 6, 7 and 8 are variants of the second embodiment described above, and show most of its features.

In a first variant of the second embodiment of the flexible guide 30, shown in FIG. 6, the holding component includes absorbers 38, 39 made of elastic material. The absorbers 38, 39 are arranged on the arms 26, 28 of the holding component. They have for example a U-shape, the walls of which are provided with tabs folded towards the inside of the U. In the operating position, the tabs are arranged on either side of the rear block, resting on the rear face of the support 11, 12. Thus, the tabs can deform when the support 11, 12 is pushed by the flexible strips 14, 15, 16, 17, for example when the movable element 13 changes the stable position.

The absorbers 38, 39 are disposed at the ends of the walls to be in contact with the supports 11, 12 of the flexible guide 30. Thus, these absorbers 38, 39 allow to improve the curvature of the elastic return moment between the stable positions, in order to give them a shape even closer to a sinusoidal function.

In FIG. 7, a second variant consists in that the longitudinal part 42 of the movable element 33 is partly flexible. The longitudinal part 42 is pierced with a longitudinal oblong through orifice bordered by two walls. Under the effect of the movement of the movable element from one stable position to another, the walls bend. Similarly to the first variant, the elastic return moment describes a function closer to a sinusoidal shape. The longitudinal part 42 comprises insertion tubes 43, 44, 45, 46 on the outer side of the walls for the flexible strips 14, 15, 16, 17.

A third variant, shown in FIG. 8, comprises a holding component provided with a flexible portion 48, 49 upstream of each end of the arms 34, 36. These portions 48, 49 provide flexibility to the arms 34, 36 when the movable element changes the stable position. Each flexible portion 48, 49 here comprises two flexible walls 51, 52, 53, 54 separated by a through opening, so that under the effect of the movement of the movable element 23 and the bending of the strips 14, 15, 16, 17, which pushes on the holding component, the walls are deformed. Similarly to the first two variants, the elastic return moment describes a function closer to a sinusoidal shape.

Figure 9:
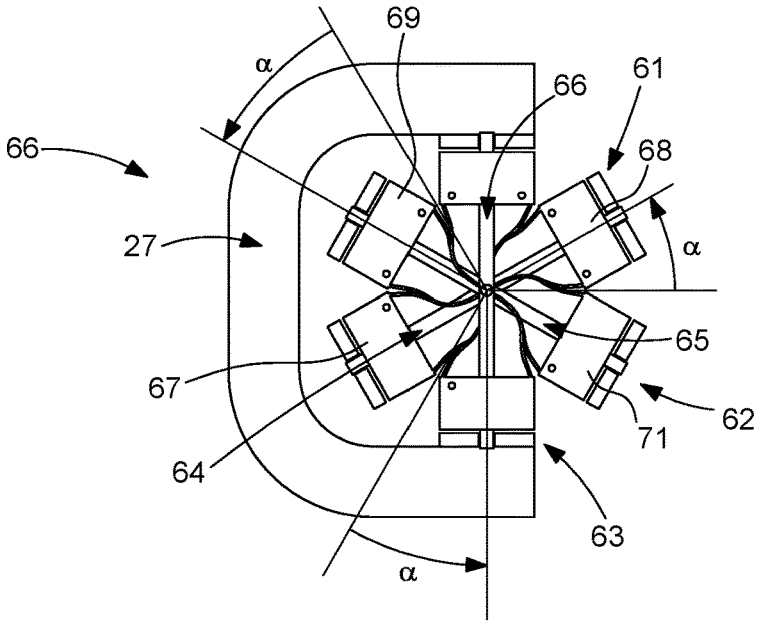
Figure 10:
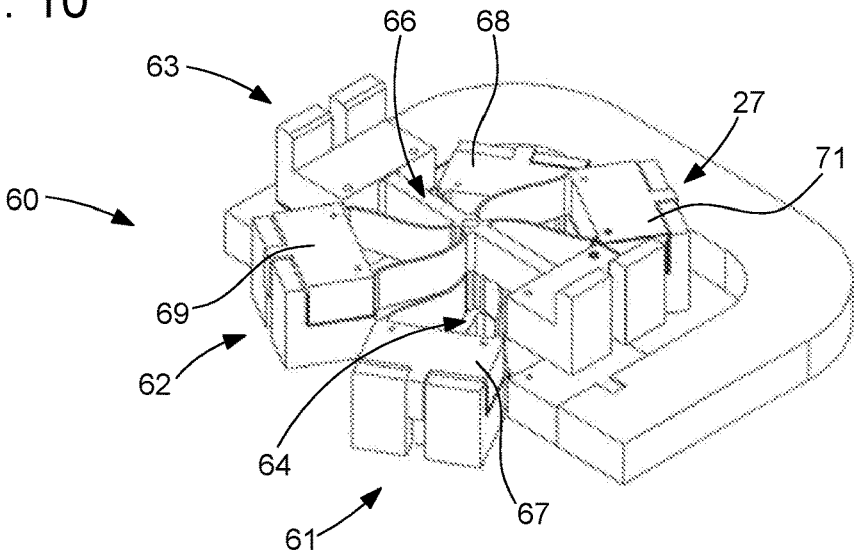

The invention also relates to a set 60 of superimposed flexible guides. In FIGS. 9 and 10, the set 60 comprises three flexible guides 61, 62, 63 such as those described in the second embodiment, with the difference that only the first flexible guide 61 includes a holding component 2 of the second embodiment. The other two flexible guides 62, 63 have different prestressing means. The two supports 67, 68 of the second flexible guide 62 are fixed to the movable element 64 of the first flexible guide 61. The supports 69, 71 of the third flexible guide 63 are fixed to the movable element 65 of the second flexible guide 62. For this purpose, the rear block of each support is inserted into a U-shaped structure of the movable element of the lower guide.

To apply a constraint on the upper flexible guide 62, 63, the distance between the two U-shaped structures of the movable element 64, 65 of the lower moving body is less than the distance between the two supports 67, 68, 69, 71 of the upper guide 62, 63 without prestress. Thus, the supports 67, 68, 69, 71 of the upper flexible guide 62, 63 are maintained compressed between the two U-shaped structures of the movable element 64, 65 of the lower guide 61, 62. The buckling force of the flexible strips is obtained by this interlocking of the supports 67, 68, 69, 71.

For each flexible guide 61, 62, 63, the angle of displacement between the two stable positions is equal to $2\alpha$, $\alpha$ being the angle formed by the position of the movable element with prestress relative to the position of the movable element without prestress. $2\alpha$ is for example comprised between 20 and 40°, preferably substantially equal to 30°. Thus, by superimposing three devices, a global angle of 90° is obtained. With such a global angle, the result is a flexible guide that is ideal for use in a resonator timepiece mechanism.

In the rest position, the upper flexible guide is oriented in a direction forming an angle corresponding to the angle formed between the two stable positions of the movable element. Thus the second axis of symmetry of the upper flexible guide forms an angle with the second axis of symmetry of the upper flexible guide, for example of 30°.

The invention also pertains to a rotary resonator timepiece mechanism, not shown in the figures.

In a first variant, the resonator mechanism is provided with a flexible guide according to the first or the second embodiment.

In a second variant, the resonator mechanism is provided with a set of superimposed flexible guides according to the invention.

The flexible guide or the set of superimposed flexible guides has the function of allowing the movable masses of the resonator mechanism to move away from the centre of rotation, when the rotational force of the mechanism is stronger, or to move closer thereto, when the rotational force of the mechanism is lower. Thus, a substantially constant rotational speed is maintained, regardless of the tension of the barrel spring.

In the examples of the rotary resonator mechanism of the applications mentioned in the preamble, the flexible guides described therein are replaced by a flexible guide according to the invention or a set of superimposed flexible guides according to the invention. For this purpose, the holding component of the lower guide is fixed to the axis, while a support of the upper guide is fixed to the movable mass of the resonator. By symmetry, a second assembly is assembled in the same way to allow the other movable mass of the resonator to move relative to the centre of rotation of the resonator.

Naturally, the invention is not limited to the embodiments described with reference to the figures and variants could be considered without departing from the scope of the invention.

The invention claimed is:

1. A flexible guide for a rotary resonator mechanism of a horological movement, the guide comprising:

a first support, an element movable relative to the first support, a first pair of flexible strips connecting the first support to the movable element, so that the movable element can displace relative to the first support by bending the strips in a circular movement about a center of rotation, the flexible guide being arranged substantially in a plane, and prestressing means, the prestressing means being configured to apply a force for buckling the first pair of flexible strips by bringing the first support closer to the movable element, so that the flexible guide comprises two stable angular positions of the movable element relative to the first support for which a return moment is zero, the two stable angular positions having a predetermined angle of rotation therebetween, wherein the return moment of the flexible guide has a substantially sinusoidal shape between the two stable angular positions.

2. The flexible guide according to claim 1, wherein the movable element has an axial symmetry and a center of rotation, the first pair of flexible strips being directed towards the center of rotation of the movable element.

3. The flexible guide according to claim 2, wherein the prestressing means comprise a spring connecting the movable element and the first support.

4. A flexible guide for a rotary resonator mechanism of a horological movement, the guide comprising:

a first support, an element movable relative to the first support, a second support, a first pair of flexible strips connecting the first support to the movable element, so that the movable element can displace relative to the first support by bending the strips in a circular movement about a center of rotation, the flexible guide being arranged substantially in a plane, a second pair of flexible strips connecting the second support to the movable element, the second support and the second pair of strips being arranged by symmetry of the first support and the first pair of flexible strips relative to the movable element, the first and second pairs of flexible strips connecting on either side the first and the second support to the movable element at its center of rotation, and prestressing means, the prestressing means being configured to apply a force on the first and second supports to buckle the first pair of flexible strips and the second pair of flexible strips, so that the flexible guide comprises two stable angular positions of the movable element relative to the first support for which a return moment is zero, the two stable angular positions having a predetermined angle of rotation therebetween, wherein the return moment of the flexible guide has a substantially sinusoidal shape between the two stable angular positions.

5. The flexible guide according to claim 4, wherein the prestressing means include a holding component comprising first and second arms, the first arm being fixed to the first support and the second arm being fixed to the second support, so as to apply the force on the first support and the second support.

6. The flexible guide according to claim 5, wherein the holding component comprises elastic structures arranged on the first and second arms to be in contact with the first and second supports.

7. The flexible guide according to claim 5, wherein the first and second arms of the holding component each comprises a deformable portion.

8. The flexible guide according to claim 4, wherein the movable element is partly flexible at the center of rotation.

9. A set of superimposed flexible guides, comprising first and second flexible guides according to claim 4, the supports of the second flexible guide being fixed to the movable element of the first flexible guide.

10. The set according to claim 9, further comprising a third flexible guide superimposed on the second flexible guide, the supports of the third flexible guide being fixed to the movable element of the second flexible guide.

* * * * *